United States Patent [19]

Kurz et al.

[11] Patent Number: 4,862,834

[45] Date of Patent: Sep. 5, 1989

[54] OPEN HOT WATER HEATER

[75] Inventors: Rolf Kurz; Reinhold Elflein, both of Bad Neustadt/Saale, Fed. Rep. of Germany

[73] Assignee: Forbach GmbH, Bad Neustadt/Saale, Fed. Rep. of Germany

[21] Appl. No.: 231,005

[22] Filed: Aug. 11, 1988

[30] Foreign Application Priority Data

Aug. 29, 1987 [DE] Fed. Rep. of Germany ..... 3728919

[51] Int. Cl.[4] ..... E22B 5/00

[52] U.S. Cl. ..... 122/13 R; 122/13 A; 126/361; 222/335

[58] Field of Search ..... 122/13 R, 13 A; 126/361; 222/335, 386.5, 395; 219/333

[56] References Cited

U.S. PATENT DOCUMENTS 2,568,107 9/1951 Allen ..... 222/335 X
2,865,541 12/1958 Hicks ..... 222/386.5
3,344,960 10/1967 Jacobs ..... 222/335

FOREIGN PATENT DOCUMENTS 3040450 11/1982 Fed. Rep. of Germany .

*Primary Examiner*—Edward G. Favors
*Attorney, Agent, or Firm*—Spencer & Frank

[57] ABSTRACT

A hot water heater includes a water tank defining a tank space for accommodating water; a cold water inlet and a hot water outlet connected to the tank; a hot water tap in the hot water outlet for controlling flow of hot water from the water tank; a cold water valve in the cold water inlet for controlling flow of cold water into the water tank; and a volume altering device for changing the tank space. The volume altering device comprises an expandable and collapsible chamber situated in the tank space and defining a chamber space hermetically separated from the tank space; and a volume varying arrangement connected to the chamber and exposed to pressure of inflowing cold water for increasing the chamber space by a predetermined volume while correspondingly reducing the tank space when the hot water tap and the cold water valve are open and for reducing the chamber space by the predetermined volume while correspondingly increasing the tank space subsequent to closing the hot water tap and the cold water valve to obtain a water-free space having the predetermined volume and forming part of the tank space.

8 Claims, 2 Drawing Sheets

OPEN HOT WATER HEATER

BACKGROUND OF THE INVENTION

This invention relates to an open hot water heater which includes a heating vessel having a cold water inlet, a hot water outlet and a device for varying the volume of the heating vessel.

In all known types of hot water heaters in which the water to be heated is stored in a tank and heated, the water will expand during the heating process. The expansion causes pressure to build up inside the tank. To avoid damage during the increase of pressure, it is necessary to use some form of volume compensation in the closed tank.

In hot water heaters found, for example, in the kitchen and/or bathroom of households, where the hot water outlet is an overflow which is connected with a tap, and through which the heated water is driven out by the inflowing cold water when the tap is open, a volume compensation is effected simply by a drop-by-drop escape of the expanded water at the tap. Such an escape of water, however, in an area where the user is often likely to be found during the heating of the water in the vessel, is considered to be a disadvantage in many customer circles, thus tending to limit the sales of a hot water heater with this type of volume compensation.

One way to overcome the aforementioned disadvantage is to conventionally equip the water tank of an open hot water heater with a volume compensation device which prevents the escape of the expansion water during the heating process. Such a device is disclosed in German Patent No. 3,040,450. This type of device has a temperature-dependent setting member which is associated with the water tank. It operates by changing the volume of the water tank according to the temperature-caused change in the volume of the heated water.

SUMMARY OF THE INVENTION

It is an object of the present invention to provide a new and improved device for changing the volume of the tank space without influencing the stability of the water tank, which operates independently of temperature and which reliably prevents escape of expansion water during the heating of the tank contents.

This objects and others to become apparent as the specification progresses, are accomplished by the invention, according to which, briefly stated, the hot water heater includes a water tank defining a tank space for accommodating water; a cold water inlet and a hot water outlet connected to the tank; a hot water tap in the hot water outlet for controlling flow of hot water from the water tank; a cold water valve in the cold water inlet for controlling flow of cold water into the water tank; and a volume altering device for changing the tank space. The volume altering device comprises an expandable and collapsible chamber situated in the tank space and defining a chamber space hermetically separated from the tank space; and a volume varying arrangement connected to the chamber and exposed to pressure of inflowing cold water for increasing the chamber space by a predetermined volume while correspondingly reducing the tank space when the hot water tap and the cold water valve are open and for reducing the chamber space by the predetermined volume while correspondingly increasing the tank space subsequent to closing the hot water tap and the cold water valve to obtain a water-free space having the predetermined volume and forming part of the tank space.

In the open hot water heater according to the invention, the device for changing the water tank volume operates in such a manner that, with the initiation of the tapping process, a closed chamber free of water is created and simultaneously a corresponding, volume-dependent quantity of water is displaced from the water tank. At the end of the tapping process, the closed chamber is eliminated and thus a corresponding space free of water becomes available in the interior of the water tank to receive the expansion water developed during the heating process. This method of forming a chamber to receive the expansion water within the water tank has the advantage that the walls of the water tank itself are not subjected to any alternating pressure stresses and therefore this device can also be used advantageously with water tanks made of plastic.

DESCRIPTION OF THE PREFERRED EMBODIMENT

Figure 1:
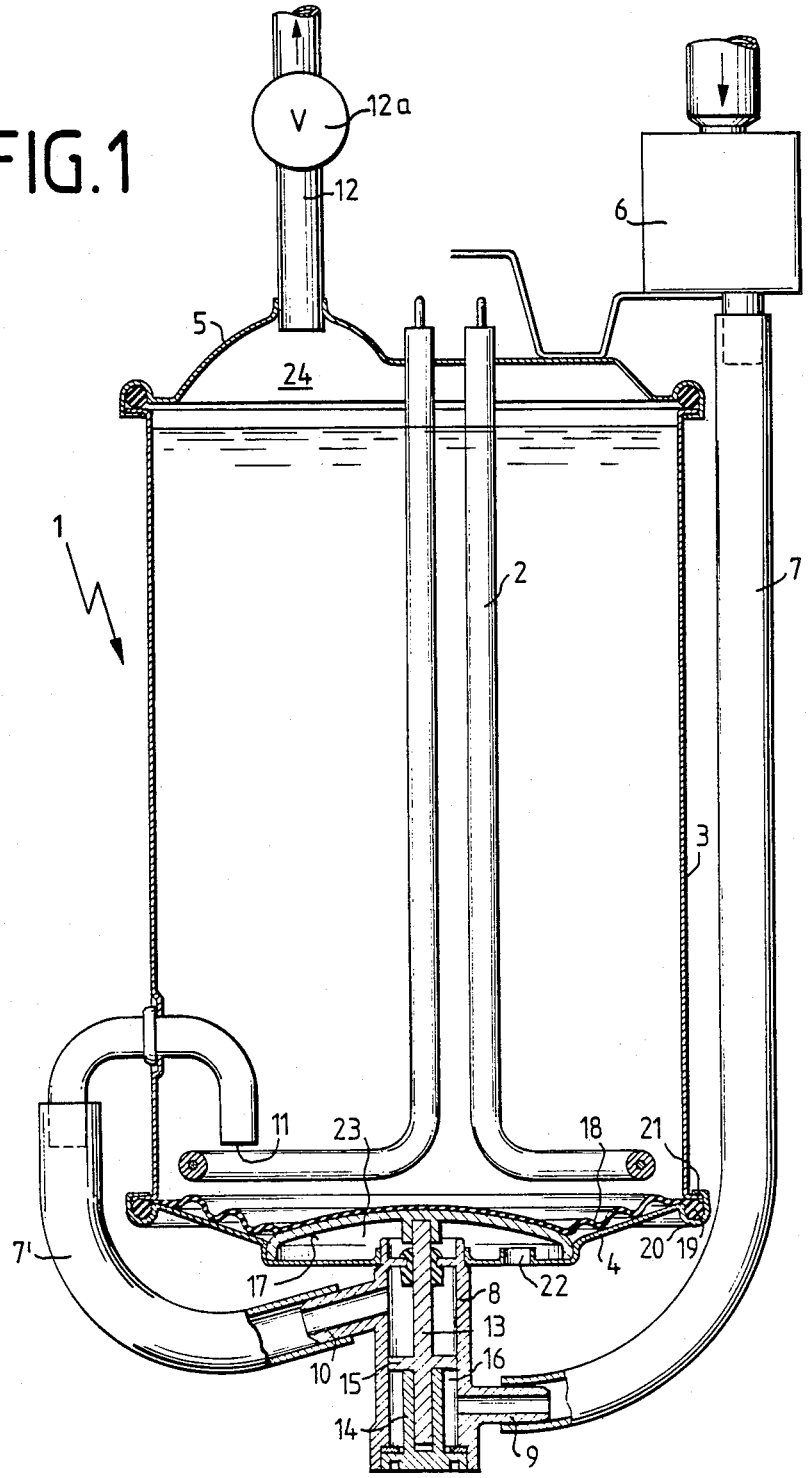
FIG. 1 is a schematic sectional elevational view of a preferred embodiment of the invention, shown in an initial position (position of rest).

Turning to FIG. 1, the "open" (pressure-free) hot water heater shown therein comprises a hot water tank generally designated at 1 and formed of an upright tubular body 3 having a hermetically affixed bottom plate 4 and a head plate 5. The water tank 1 is equipped with an electrical heating device 2, and is supplied with cold water by a cold water inlet pipe 7 which is controlled by a magnetic valve 6. The inlet pipe 7 extends externally along the tank body 3 and is connected in a region below bottom plate 4 to a valve and plunger housing body 8 mounted to the bottom plate 4. The inlet pipe 7 is connected to an inlet nipple 9 which is located at the base of the valve and plunger housing body 8. Above and on the side opposite the inlet nipple 9, the valve and plunger housing body 8 supports an outlet nipple 10. A pipe elbow unit 7' forms a continuation of cold water inlet pipe 7 and is connected to the outlet nipple 10. In the lower portion of water tank body 3, the pipe elbow unit 7' passes in a watertight manner through the wall of the tank body, with its cold water outlet 11 being oriented toward the bottom region of the water tank 1. A hot water outlet pipe 12 is inserted in head plate 5 of water tank body 3 for removal of heated water which is displaced to a water tap (valve) **12*a*** by the cold water entering the tank at the bottom.

The valve and plunger housing body 8 includes a plunger 13 positioned in a guide member 14. The plunger 13 includes a valve plate 15. In the rest or starting position, valve plate 15 is seated tightly on guide member 14 and maintains closed an accumulation chamber 16 which is in communication with the cold water inlet pipe 7. The plunger 13 protrudes upwardly through the valve and plunger housing body 8. It extends above the bottom plate 4 of water tank 1, and is equipped in this region with a cap-like member 17. Directly above the member 17 in the interior of water tank 1 is a membrane-like, flexible sealing plate 18 which is in a face-to-face engagement with a slightly convex outer surface of the cap-like member 17. The membrane-like sealing plate 18 has a circumferential edge bead 19 inserted into a recessed flanged edge 20 which is part of bottom plate 4. The bottom plate 4 and the sealing plate 18 are tightly connected with a lower flange edge 21 of water tank body 3. In the region below the member 17, a ventilation opening 22 is provided in bottom plate 4.

Figure 2:
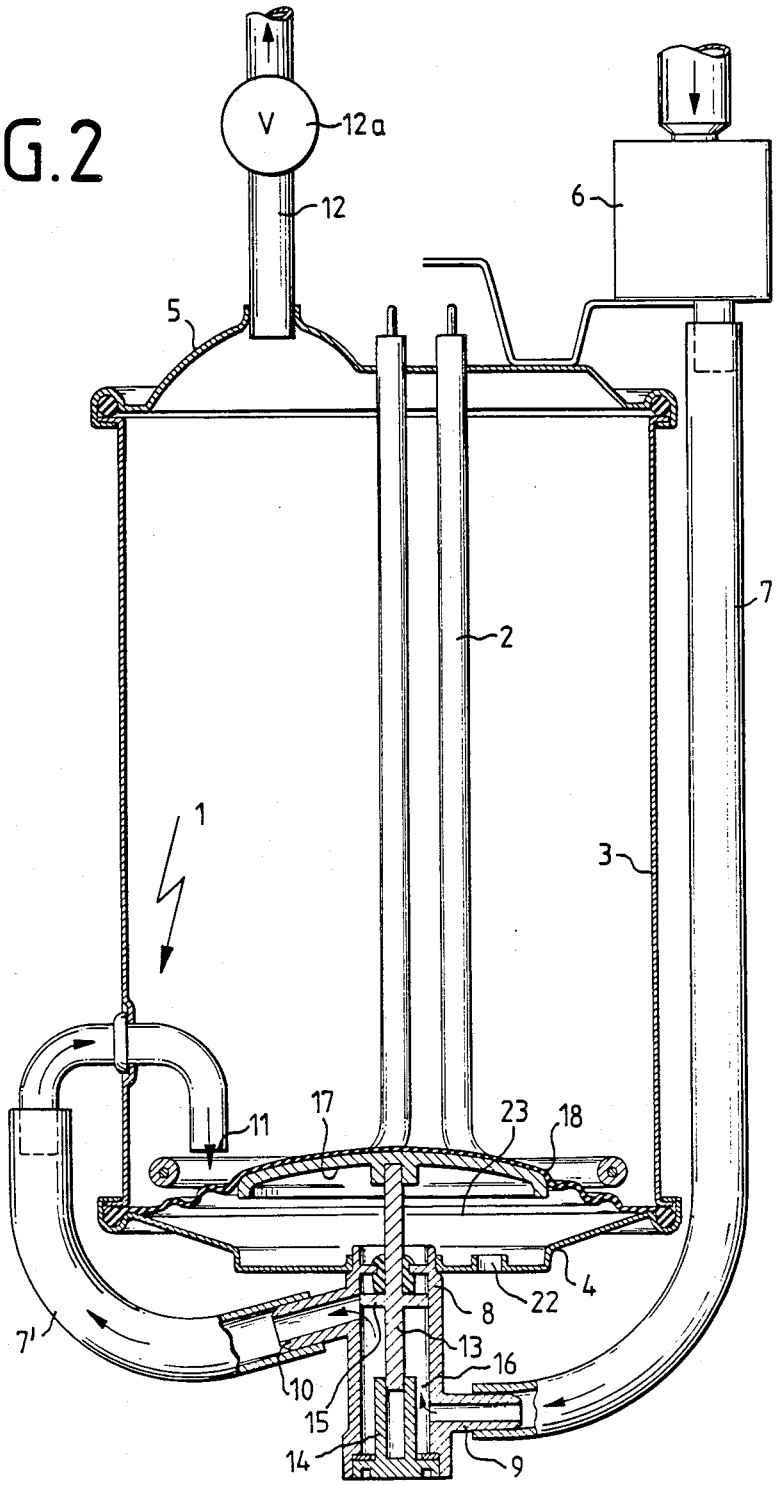
FIG. 2 is a schematic sectional elevational view of the preferred embodiment, shown in an operational position.

In the description which follows, the operation of the above-described device will be set forth, with particular reference to FIG. 2.

In FIG. 2, the arrows shown in cold water inlet pipe 7, the valve and plunger housing body 8 and pipe elbow unit 7' indicate the directional flow of the water through the device.

When the hot water tap 12*a* connected to hot water outlet pipe 12 is opened, the magnetic valve 6 is simultaneously also caused to open, permitting the flow of cold water into cold water inlet pipe 7. The then existing pressure of the cold water which is accumulated in chamber 16 acts against the plate 15 of plunger valve 13. As a result, the plunger valve 13 is lifted, raising the cap 17. The membrane-like sealing plate 18 which is tensioned across the cap 17 is thus also lifted. Upward displacement of the sealing plate 18 drives a certain volume-dependent quantity of water (about 4% of the contents of the water tank) through hot water outlet pipe 12 to the hot water tap. At the same time, between the membrane-like sealing plate 18 and bottom plate 4, a water-free chamber 23 develops whose volume is about 4% of the water content of water tank 1.

When the plunger 13 in the valve and plunger housing body 8 has reached its end position, it establishes hydraulic communication between the pipe elbow unit 7' and the cold water pipe 7 thus permitting cold water to flow through pipe elbow unit 7' to water tank 1. As long as the hot water tap 12*a* is open, the influx of cold water pushes hot water to the tap through hot water outlet pipe 12. Closing the hot water tap 12*a* and thus interrupting the flow of cold water to hot water tank 1 causes the plunger 13, and the cap 17 to return to their starting positions as shown in FIG. 1. Due to the pressure of the water present in water tank 1, membrane-like sealing plate 18 necessarily follows the withdrawal of plunger valve 13 and thus the chamber 23 collapses. The water level in water tank 1 will drop in correspondence with the reduction in the volume of the space in the chamber 23. Thus, a water-free space 24, as shown in FIG. 1, corresponding in volume to that of the previously expanded chamber 23 is formed in water tank 1. This water-free space 24 serves for receiving the expansion water developed during the heating of the contents of the water tank, thus preventing water from dripping out of the hot water tap.

The present disclosure relates to subject matter contained in Federal Republic of Germany Patent Application No. P 37 28 919.5 (filed Aug. 29th, 1987) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a hot water heater including a water tank defining a tank space for accommodating water;

means defining a cold water inlet and a hot water outlet connected to said tank;

a hot water tap in said hot water outlet for controlling flow of hot water from said water tank;

a cold water valve in said cold water inlet for controlling flow of cold water into said water tank;

heating means for heating the water in said water tank; and volume altering means for changing said tank space;

the improvement wherein said volume altering means comprises an expandable and collapsible chamber means situated in said tank space and defining a chamber space hermetically separated from said tank space; and volume varying means connected to said chamber means and exposed to pressure of inflowing cold water for increasing said chamber space of said chamber means by a predetermined volume while correspondingly reducing said tank space when said hot water tap and said cold water valve are open and for reducing said chamber space by said predetermined volume while correspondingly increasing said tank space subsequent to closing said hot water tap and said cold water valve to obtain a water-free space having said predetermined volume and forming part of said tank space.

2. A hot water heater as defined in claim 1, wherein said chamber means comprises a flexible sealing plate positioned in the interior of the water tank and bounding said tank space and said chamber space;

further wherein said volume varying means includes a plunger exposed to and being movable by the pressure of inflowing cold water from said cold water inlet; and means for connecting said plunger with said sealing plate for moving said sealing plate by said plunger in response to said pressure.

3. A hot water heater as defined in claim 2, wherein said water tank is closed at a lower end by a bottom plate forming part of said chamber means and being sealingly affixed to said flexible sealing plate along a periphery thereof; further wherein said means for connecting said plunger with said sealing plate comprises a cap-shaped member having an outer surface being in a face-to-face engagement with said sealing plate and being affixed to said plunger; said plunger extending into said chamber space and said cap-shaped member being situated within said chamber space.

4. A hot water heater as defined in claim 2, wherein said bottom plate further comprises means defining a ventilation opening to connect said chamber space with the atmosphere.

5. A hot water heater as defined in claim 3, wherein said flexible sealing plate has an edge bead extending along said periphery and said water tank includes a tubular upright tank body having a lower edge zone provided with a circumferential recess; said edge bead being received in said circumferential recess; said bottom plate and said flexible sealing plate being sealingly connected with said lower edge zone of said tank body.

6. A hot water heater as defined in claim 3, further comprising a plunger housing body secured to said bottom plate and having an interior receiving one part of said plunger; and a guide mounted in said plunger housing body and being arranged for guiding said plunger; said cold water inlet comprising a first cold water pipe extending from said cold water valve to said plunger housing body and communicating with the interior thereof to introduce cold water thereinto in an open state of the cold water valve and a second cold pipe adapted to communicate with the interior of said plunger housing body and extending therefrom into said tank space; said plunger being exposed to and being movable by the pressure of water introduced into said interior by said first cold water pipe.

7. A hot water heater as defined in claim 6, further comprising a valve member affixed to said plunger and arranged for establishing or blocking hydraulic communication between said second cold water pipe and said interior of said plunger housing body dependent upon positions of said plunger.

8. A hot water heater as defined in claim 6, wherein said first cold water pipe extends externally of said water tank.

* * * * *